United States Patent [19]

Mager

[11] 4,129,304

[45] Dec. 12, 1978

[54] SELF-LIMITING BOARD GAME COMBINING CHANCE AND SKILL

[76] Inventor: Eric L. Mager, 22 Columbus Ave., Beverly, Mass. 01915

[21] Appl. No.: 818,766

[22] Filed: Jul. 25, 1977

[51] Int. Cl.[2] ..... A63F 3/00

[52] U.S. Cl. ..... 273/243; 273/242; 273/274; 273/288

[58] Field of Search ..... 273/274, 242, 271, 269, 273/243, 288, 290, 256

[56] References Cited

U.S. PATENT DOCUMENTS

| | | | |
|---|---|---|---|
| 88,421 | 3/1869 | Slagle | 273/269 |
| 1,266,857 | 5/1918 | Recker | 273/290 X |
| 1,669,470 | 5/1928 | Jasper | 273/274 |
| 3,111,320 | 11/1963 | Acosta | 273/271 |
| 3,549,150 | 12/1970 | Weeks | 273/269 |
| 3,633,915 | 1/1972 | Lippert | 273/274 |
| 3,977,677 | 8/1976 | Magiera | 273/255 |

FOREIGN PATENT DOCUMENTS

| | | | |
|---|---|---|---|
| 673136 | 6/1952 | United Kingdom | 273/274 |

*Primary Examiner*—Anton O. Oechsle
*Assistant Examiner*—Harry G. Strappello
*Attorney, Agent, or Firm*—Oblon, Fisher, Spivak, McClelland & Maier

[57] ABSTRACT

Board game apparatus comprising a supply of chips associated with each player for wagering, and a game board including a plurality of locations arranged thereon forming a game movement area, the locations allowing the wagered chips to be located thereon. Further included are apparatus for setting a quantity of the chips to be wagered, and for randomly choosing a location on the game board for the chips; and a plurality of playing pieces representing the individual players for moving around the locations to capture the chips.

9 Claims, 4 Drawing Figures

SELF-LIMITING BOARD GAME COMBINING CHANCE AND SKILL

BACKGROUND OF THE INVENTION

1. Field of the Invention

The present invention relates generally to a board game and more particularly to a board game combining chance and skill.

2. Description of the Prior Art

Board games are a well-known form of amusement to fill the leisure hours. Many such devices prove unsuccessful, however, because they lack the requisite elements of risk and intellectual challenge necessary to maintain a high degree of interest for an extended period of time.

BRIEF SUMMARY OF THE INVENTION

Accordingly, it is an object of this invention to provide an improved board game apparatus.

It is also an object of the present invention to provide such apparatus for allowing the play of a board game which combines chance and skill.

It is further an object of the present invention to provide such apparatus for allowing the play of a board game in the course of which each player must hazard increasingly larger total stakes in the outcome, while being offered greater opportunities to win by means of skillful play.

A board game according to this invention comprises a plurality of stakes associated with each player of the board game for wagering during play; a game board including a plurality of locations arranged thereon forming a game movement area, the locations allowing the stakes to be located thereon; means for setting a quantity of the stakes to be wagered; means for randomly choosing a location on the game board for the quantity of stakes; and a plurality of playing pieces representing the individual players for moving around the locations of the game movement area to capture the stakes.

The board game has the following advantageous features:

(1) the players must each keep putting up recurring and variable stakes, and must place them on the playing area at various locations;

(2) the amount and location of each stake is determined by chance;

(3) the players may capture the stakes from the board, exercising their best vision, skill and judgement in evaluating and acting upon different successive situations;

(4) the captured stakes contribute to each player's periodically increasing power to make further captures;

(5) the game ends when one player wins by "sweeping the board"; i.e., he captures at one turn all of the stakes then available to be captured;

(6) the winning player gets all of the total accumulated investments made by all of the players during the game.

These principles contribute to making the game uncomplicated, self-limiting, challenging, suspenseful and rewarding.

BRIEF DESCRIPTION OF THE DRAWINGS

A more complete description of the invention and many of the attendant advantages thereof will be readily obtained as the same becomes better understood by reference to the following detailed description when considered in connection with the accompanying drawings wherein.

DETAILED DESCRIPTION OF THE PREFERRED EMBODIMENTS

There will now be described, by reference to the appended drawings, board games according to the first to the fourth embodiments.

FIRST EMBODIMENT

Figure 1:
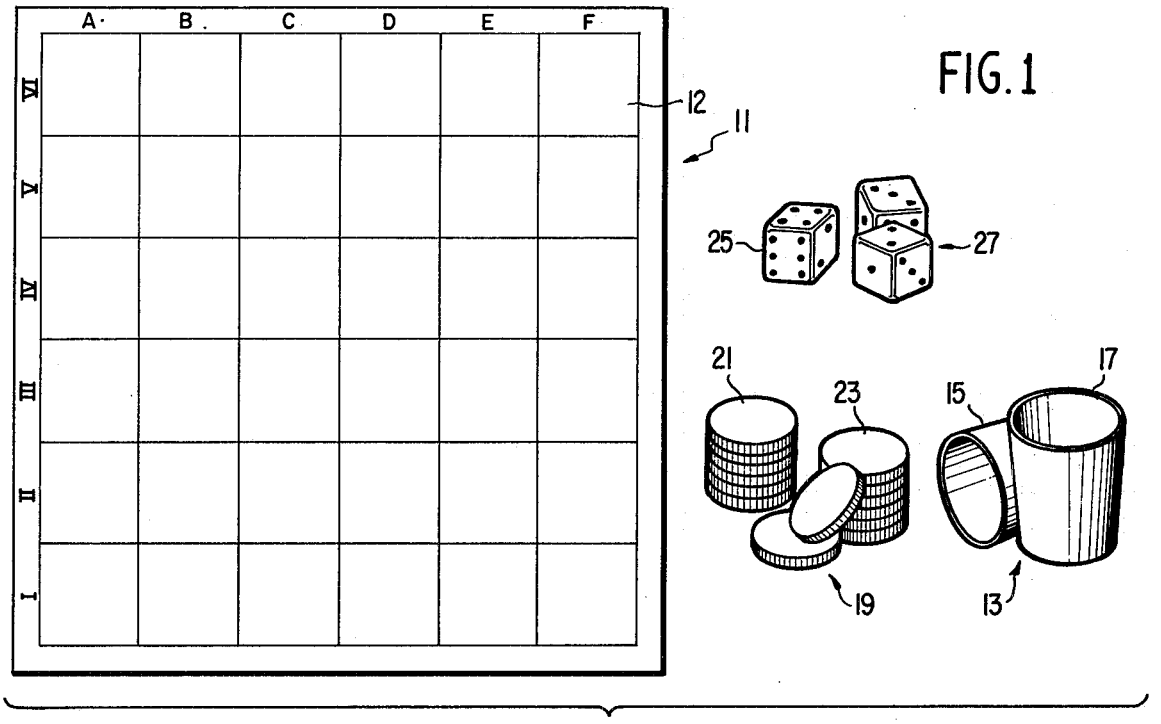
FIG. 1 shows a top plan view of a game board according to a first embodiment of the present invention, including perspective views of various of the remaining apparatus for play of the board game.

Referring to FIG. 1, a game board is shown and generally designated 11. The game board includes a plurality of connected locations forming a game movement area. In the first embodiment, the game board is square and is divided into a square matrix of 36 smaller interconnected squares 12 arranged in a $6 \times 6$ array, the rows and columns of squares respectively being identified by distinctive marks or symbols along perpendicular edges of the board. While such marks or symbols may take a variety of forms, they may take the form illustrated in FIG. 1 wherein these indicia are shown as capital letters for the columns and roman numerals for the rows. Also shown in FIG. 1 are a plurality of individual playing pieces, generally designated 13 shown as situated adjacent to the board 11. Pieces 13 include separate playing pieces 15 and 17, which may be in the form of cups as illustrated in FIG. 1, or in any other form making them separately identifiable.

The board game further includes a plurality of stake means associated with each player for wagering. While such means may take a variety of forms, it may take the form illustrated in FIG. 1 of game chips generally designated 19. Chips 19 include separate chip stacks 21 and 23, in which the chips may all be of unit value, or multiple-value chips may be added to supplement the unit-value chips.

The board game further includes means for setting a quantity of the stake means to be wagered 25, and means for randomly choosing the location on the game board for the set quantity of the stake means 27. While such means may take a variety of forms, they may take the form illustrated in FIG. 1 wherein means 25 is shown as a die, and means 27 is shown as a pair of dice. The dice 25 and 27 are cubical in shape with six outer faces. One of the pair of dice 27 has imprinted on its faces the indicia for the columns and the other has imprinted on its faces the indicia for the rows of the game movement area. If, for example, monochrome symbols are used as illustrated, then all three dice can be white. Two of the dice 27 must have special imprinting of the appropriate symbols replacing the conventional pips; the third die 25 has pips. On the other hand, if colored numbers identify the rows and columns of the playing area, then all three dice have pips, but two must be colored to match the colored numbers; the third die 25 remains white.

The objective of the board game of the present invention is to capture all of the wagered chips 19 available to be captured by movement of the playing pieces 13 on the game board 11.

The game is played by at least two persons. Each player is given a stack of chips such as stacks 21 and 23 as shown in FIG. 1. Each player is assigned playing pieces 13 such as playing pieces 15 and 17. Playing pieces 15 and 17 are placed upon agreed upon squares within the playing area. The players alternate turns.

The first player, assumed for the purpose of this description to have been assigned playing piece 15 is then ready to begin play. He rolls dice 25 and 27 together. The number shown on the die 25 determines the quantity of the stake means, that is the number of chips, from one to six, to be wagered on that turn. The pair of dice 27 show the location, for example "row II, column C" on the game board 11 for locating the selected quantity of chips. The set quantity of chips is counted out twice by the player from his stack 21 and placed once on the identified square, and once in the player's cup, or if other forms of playing pieces are used, into his assigned part of a common jackpot. If the identified square is occupied by the opponent's playing piece, the chips are lost to the opponent and placed in the opponent's cup or into his assigned part of the jackpot. Most of the time, of course, chips placed on the game board will land on an empty square.

Having made his wager, the player next has the option of moving his playing piece 15 or of staying put. To determine his allowed number of moves for that turn, the player divides his accumulated total of chips in the cup or jackpot by an integer, preferably 10. The whole number in the quotient, disregarding any leftover remainder, is the number of allowed moves. The player may use any, all or none of his available moves. The playing piece is moved in the same way as the knight is in chess, but may not land on a location where the opponent's playing piece is located. A player's playing piece can capture the chips on any square on which it lands. The captured chips then go into the player's cup or into the jackpot and are tallied, but do not increase his number of allowed moves on that turn, unless all players so agree beforehand.

If, at any turn, the player does not use all the moves to which he is entitled, the unused moves are forfeited and may not be carried over. As compensation, however, the player adds one chip to his cup or to the jackpot for each forfeited move. In the event that the player does not move his cup at all in a turn, he adds to his cup or to the jackpot two chips per move, instead of one. In other words, one chip per move for a partial forfeit; two chips per move for a total forfeit.

The game ends when a player in one turn captures all the chips then on the game board 11, no matter how many or how few that may be. The player who achieves this sweep wins the game and gets all of the chips in all of the players' cups or the jackpot. The winning player also has the privilege of starting the next game.

The strategy of play demands that the player make choices among various possible actions of inaction, each of which involves varying degrees of countervailing benefit versus risk. A strategy of moving on the game movement area so as to capture as many chips as possible will tend to maximize the player's allowed moves in subsequent turns, and by the same token lessen his opponents' opportunities for similar gains. But, reducing the number of squares containing chips also reduces the number of moves which the opponent may need on the next turn in order to consummate a sweep. It will be readily appreciated that no matter how many chips are captured by any player, none are secure for him unless and until he wins. Further, since each player's total accumulation of chips inexorably increases during the course of the game, and therefore the number of allowed moves per turn, the probability of some player achieving the sweep necessary to win also keeps increasing. Eventually a sweep by someone must occur. This makes the game self-limiting — it cannot go on indefinitely — and therefore the game must be won within a tolerable time. It is interesting to note that the average duration of the game (repetitively played) can be regulated as desired through choice of the number to be used as the divisor of each player's chip-total at each turn. The relationship is a function with direct (not inverse) correlation. The larger the number, the longer the game (on average); the smaller the number, the shorter the game.

SECOND EMBODIMENT

Figure 2:
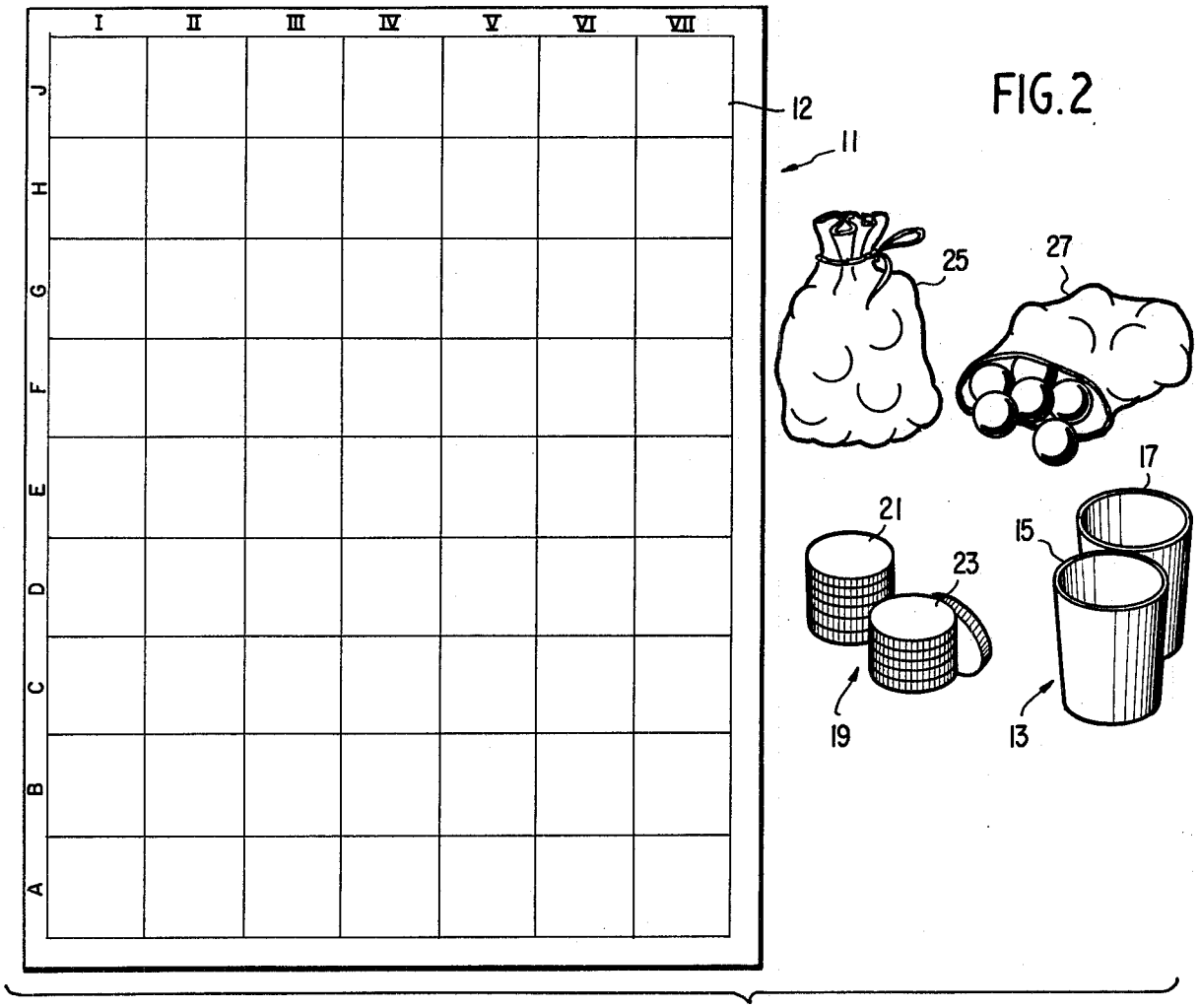
FIG. 2 shows a top plan view of the game board according to a second embodiment of the present invention, including perspective views of various of the remaining apparatus for play of the board game.

A second embodiment of the board game is shown in FIG. 2. This embodiment differs from the embodiment of FIG. 1 in having a game board 11 which is rectangular in form and divided into a matrix of 63 smaller connected squares arranged in a $9 \times 7$ array. The rows and columns of squares respectively are, as before, identified by a distinctive mark or symbol along perpendicular edges of the board. Means for setting a quantity of the stake means to be wagered 25 as well as means for randomly choosing a location on the game board for the set quantity of the stake means 27 of another type are shown in this embodiment. Instead of dice, three bags or other containers of balls, or other convenient pieces, may be used. One bag contains seven balls marked I, II, III, IV, V, VI, and VII; another bag contains nine balls marked A, B, C, D, E, F, G, H, and J; the third bag contains eight balls marked 1, 2, 3, 4, 5, 6, 7, and 8.

Each player, on beginning a turn, shakes the three bags sufficiently to randomly mix the contents. Then by blind pick, he withdraws one ball from each. The balls from the first two bags identify a unique square on the game board 11. The arabic numeral on the ball withdrawn from the third bag sets the quantity of the player's stake means to be wagered. The withdrawn balls are returned to the bags at the end of each turn.

THIRD EMBODIMENT

Figure 3:
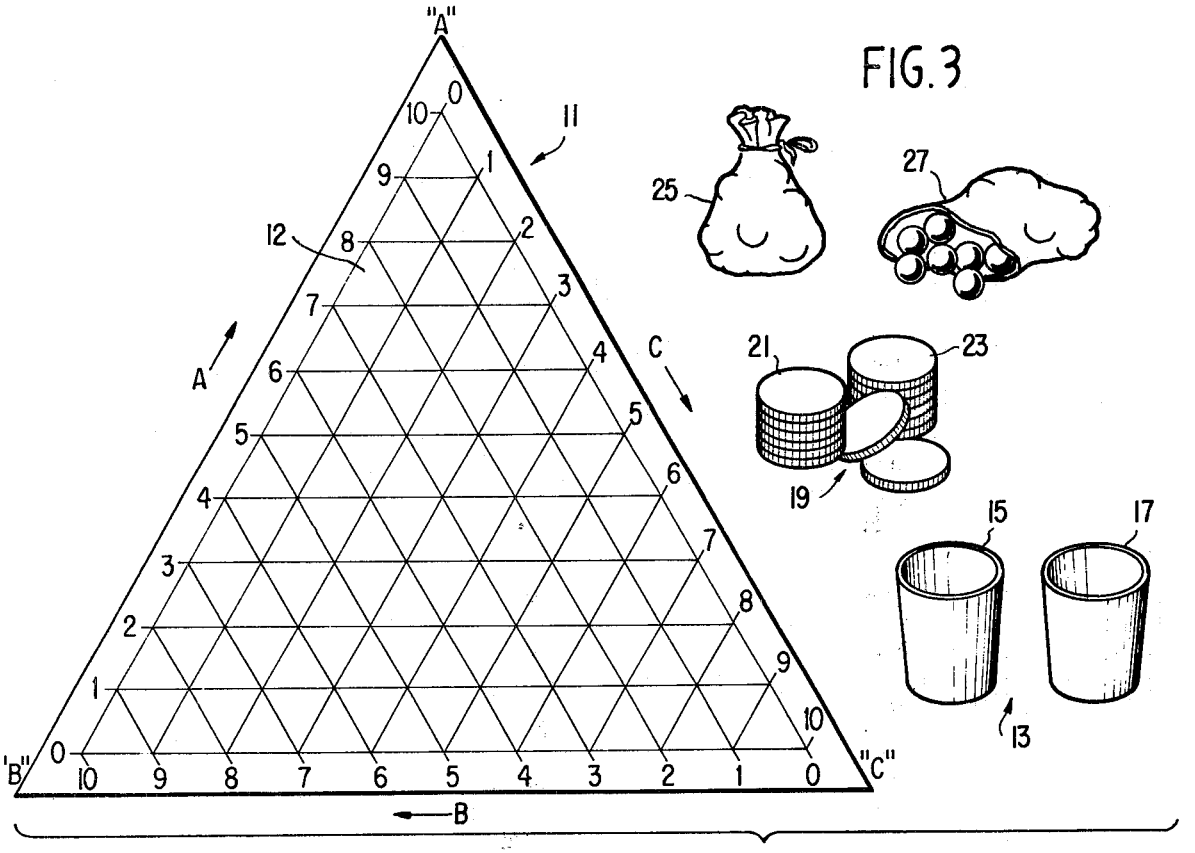
FIG. 3 shows a top plan view of the game board according to a third embodiment of the present invention, including perspective views of various of the remaining apparatus for play of the board game.

A third embodiment of the invention is shown in FIG. 3. This embodiment differs from the embodiment of FIG. 1 in having a game board 11 which is triangular in form and divided into an array of smaller interconnected, preferably equilateral, triangles. The coordinate axes for the description of the triangles are identified by distinctive marks or symbols along the three edges of the board. The vertices of the triangles, rather than the area enclosed by each triangle, are the locations which form the game movement area. For example, vertex A is characterized as ($A = 10, B = 0, C = 0$), whereas the mid-point of the base of the large is characterized by ($A = 0, B = 5, C = 5$). Referring to FIG. 3, it may be seen that the entire game movement area contains a total of 66 intersections or vertices. In the third embodiment the means for setting a quantity of the stake means to be wagered 25 can take the form of a bag of, say, six balls numbered from one to six; and the means for randomly choosing a location on the game board for the set quantity of the stake means 27 can take the form of a bag of 66 balls, each ball being properly marked to correspond to one of the 66 intersections. In this embodiment, each move of the playing pieces comprises moving a playing piece four intersections in any direction or combination of directions.

FOURTH EMBODIMENT

Figure 4:
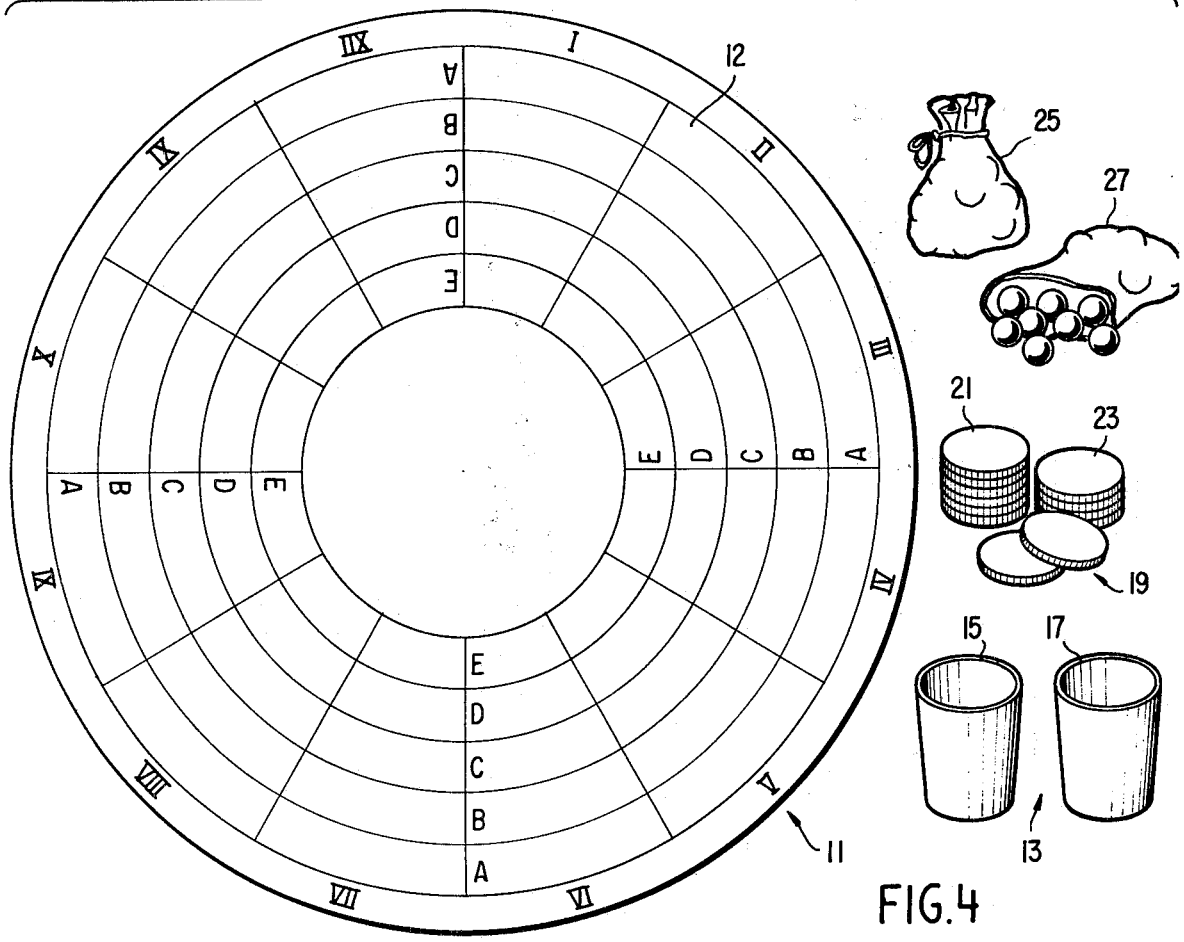
FIG. 4 shows a top plan view of the game board according to a fourth embodiment of the present invention, including perspective views of various of the remaining apparatus for play of the board game.

A fourth embodiment of the invention is shown in FIG. 4. This embodiment differs from the embodient of FIG. 1 in having a game board 11 which is circular in form and divided into an array of concentric ring-like segments 12, the rows and columns of the segments respectively being identified by a distinctive mark or symbol along the circumference and radii of the circular game board. The ring-like segments form the game movement area. In this embodiment, each move of the playing pieces comprises moving a playing piece four spaces, either circumferentially, radially, or any combination thereof.

Obviously, numerous additional modifications and variations of the present invention are possible in light of the above teachings. For example, the means for setting a quantity of the stake means to be wagered 25, and the means for randomly choosing a location on the game board for the set quantity of the stake means 27 could take the form of a conventional slot machine type of device. Such a device would be much easier to use than bags of balls, and would be faster. It is therefore to be understood that within the scope of the appended claims, the invention may be practiced otherwise than as specifically described herein.

What is new and desired to be secured by letters patent in the United States is:

1. A self-limiting board game combining chance and skill comprising:

a plurality of stake means associated with each player of the board game for wagering during play;

a game board including a plurality of locations arranged thereon forming a game movement area, the locations allowing the stake means to be located thereon;

means for setting a quantity of the stake means to be wagered;

means for randomly choosing a location on the game board for the quantity of stake means; and a plurality of playing pieces representing the individual players for movement around the locations of the game movement area to capture the stake means.

2. The game recited in claim 1 wherein the locations comprise interconnected squares.

3. The game recited in claim 1 wherein the locations comprise the vertices of interconnected triangles.

4. The game recited in claim 1 wherein the locations comprise segments of concentric rings.

5. The game recited in claim 1 wherein the location choosing means comprises a pair of dice.

6. The game recited in claim 1 wherein the location choosing means comprises a bag of marked balls.

7. The game recited in claim 1 wherein the quantity setting means comprises a die.

8. The game recited in claim 1 wherein the quantity setting means comprises a bag of marked balls.

9. The game recited in claim 1 wherein the playing pieces comprise cups.

* * * * *